US007861708B1

(12) United States Patent
Lyons

(10) Patent No.: US 7,861,708 B1
(45) Date of Patent: Jan. 4, 2011

(54) DRAFT INDUCER BLOWER MOUNTING FEATURE WHICH REDUCES OVERALL SYSTEM VIBRATION

(75) Inventor: Leslie A. Lyons, Cassville, MO (US)

(73) Assignee: Fasco Industries, Inc., Springfield, MO (US)

( * ) Notice: Subject to any disclaimer, the term of this patent is extended or adjusted under 35 U.S.C. 154(b) by 1372 days.

(21) Appl. No.: 11/346,909

(22) Filed: Feb. 3, 2006

(51) Int. Cl.
*F24H 3/02* (2006.01)

(52) U.S. Cl. ..... 126/110 A; 126/104 R; 126/104 A; 126/112; 415/206; 415/213.1; 415/214.1; 416/244 R; 417/423.14; 454/186

(58) Field of Classification Search ..... 110/104 R; 126/104 A, 110 A; 415/206, 213.1, 214.1; 454/186
See application file for complete search history.

(56) References Cited

U.S. PATENT DOCUMENTS

| | | | | | |
|---|---|---|---|---|---|
| 2,297,049 | A | * | 9/1942 | Cotton et al. | 417/353 |
| 3,601,502 | A | * | 8/1971 | Harter | 416/244 R |
| 3,856,431 | A | | 12/1974 | Tucker | 415/219 |
| 4,295,826 | A | * | 10/1981 | Vasilantone | 432/185 |
| 4,568,243 | A | * | 2/1986 | Schubert et al. | 415/213.1 |
| D282,869 | S | | 3/1986 | Parnell | D23/335 |
| 4,599,042 | A | | 7/1986 | Colliver | 415/204 |
| D289,680 | S | | 5/1987 | Heob | D23/386 |
| 4,865,517 | A | * | 9/1989 | Beehler | 415/214.1 |
| 4,892,045 | A | * | 1/1990 | Schumacher | 110/203 |
| 4,943,209 | A | * | 7/1990 | Beehler | 416/204 R |
| 4,960,102 | A | * | 10/1990 | Shellenberger | 126/110 R |
| 4,978,281 | A | * | 12/1990 | Conger, IV | 417/423.15 |
| 5,040,943 | A | * | 8/1991 | Dwyer et al. | 415/26 |
| 5,055,006 | A | * | 10/1991 | Kobayashi et al. | 417/366 |
| 5,158,432 | A | * | 10/1992 | Cox | 415/214.1 |
| 5,245,236 | A | * | 9/1993 | Horng | 310/67 R |
| 5,257,904 | A | | 11/1993 | Sullivan | 415/214.1 |
| 5,316,439 | A | | 5/1994 | Gatley, Jr. et al. | 415/119 |
| 5,320,087 | A | * | 6/1994 | Froman | 126/110 R |
| 5,326,025 | A | * | 7/1994 | Dempsey et al. | 236/11 |
| 5,341,795 | A | * | 8/1994 | Chou et al. | 126/110 R |
| 5,368,010 | A | * | 11/1994 | Weber et al. | 126/110 R |
| 5,375,586 | A | * | 12/1994 | Schumacher et al. | 126/110 R |
| 5,379,751 | A | * | 1/1995 | Larsen et al. | 126/110 R |
| 5,443,364 | A | | 8/1995 | Mistry et al. | 415/214.1 |
| 5,448,986 | A | * | 9/1995 | Christopher et al. | 126/110 R |
| 5,484,259 | A | | 1/1996 | Ahmed et al. | 415/119 |
| 5,555,647 | A | * | 9/1996 | Torborg et al. | 34/601 |

(Continued)

*Primary Examiner*—Kenneth B Rinehart
*Assistant Examiner*—Jorge Pereiro
(74) *Attorney, Agent, or Firm*—Thompson Coburn LLP

(57) ABSTRACT

A draft inducer blower for high efficiency furnaces, including a blower housing which provides enhanced contact between the blower housing and the furnace collector box to reduce the flexing and vibration between the blower housing and the collector box. The blower housing includes contact structure which provides a direct abutting contact relationship between the blower housing and the collector box at least along a substantial periphery of the blower housing and/or at one or more rigid transition points on the collector box. In one embodiment, the contact structure can be part of the blower housing body and/or the blower housing cover. In another embodiment, the contact structure can be part of the collector box or furnace to which the blower housing is mounted. When fasteners secure the blower housing to the collector box, the contact structure provides a substantially integral rigid construct between the blower housing and the collector box.

14 Claims, 11 Drawing Sheets

U.S. PATENT DOCUMENTS 5,560,120 A * 10/1996 Swanson et al. ..... 34/82
5,573,383 A * 11/1996 Uemura et al. ..... 417/360
5,582,159 A * 12/1996 Harvey et al. ..... 126/110 R
5,620,302 A 4/1997 Garrison et al. ..... 415/169.2
5,623,918 A * 4/1997 Swilik et al. ..... 126/110 R
5,704,343 A * 1/1998 Ahn et al. ..... 126/110 R
5,954,476 A 9/1999 Stewart et al. ..... 415/214.1
6,029,653 A * 2/2000 Tiszai ..... 99/403
6,071,078 A * 6/2000 Schlegel et al. ..... 416/247 R
6,152,646 A * 11/2000 Muller-Blech et al. ... 403/408.1
D439,648 S 3/2001 Jones et al. ..... D23/370
6,227,191 B1 * 5/2001 Garloch ..... 126/110 R
6,231,311 B1 5/2001 Gatley et al. ..... 417/53
6,262,504 B1 * 7/2001 Bartlett ..... 310/89
6,305,369 B1 * 10/2001 Garloch ..... 126/116 A
6,314,894 B1 11/2001 Gatley, Jr. ..... 110/341
6,352,431 B1 3/2002 Gatley, Jr. ..... 432/77
6,353,303 B1 3/2002 Ramachandran et al. .... 318/727
6,386,123 B1 5/2002 Gatley, Jr. ..... 110/162
6,435,818 B1 8/2002 Gatley, Jr. ..... 415/119
6,468,034 B1 10/2002 Garrison et al. ..... 415/212.1
6,484,798 B1 * 11/2002 Manohar et al. ..... 165/170
6,494,152 B2 12/2002 Gatley, Jr. ..... 110/341
6,511,288 B1 1/2003 Gatley, Jr. ..... 415/206
6,511,290 B1 1/2003 Gatley, Jr. ..... 415/212.1
6,530,346 B1 3/2003 Coones et al. ..... 122/4 R
6,553,923 B2 4/2003 Gatley, Jr. ..... 110/162
6,575,696 B1 6/2003 Lyons et al. ..... 415/119
6,595,146 B2 7/2003 Gatley, Jr. ..... 110/162
6,595,201 B2 * 7/2003 Garloch et al. ..... 126/116 A
6,602,058 B1 8/2003 Stewart ..... 417/366
6,604,906 B2 8/2003 Ozeki et al. ..... 415/204
6,622,660 B1 9/2003 Bajic et al. ..... 122/13.01
6,665,991 B2 * 12/2003 Hasan ..... 52/410
6,757,155 B2 * 6/2004 Koike et al. ..... 361/600
6,785,146 B2 * 8/2004 Koike et al. ..... 361/759
6,793,015 B1 * 9/2004 Brown et al. ..... 165/170
6,882,539 B2 * 4/2005 Koike et al. ..... 361/752
6,894,897 B1 * 5/2005 Nagurny et al. ..... 361/695
6,899,516 B2 * 5/2005 Wang ..... 415/60
6,908,281 B2 * 6/2005 Lyons et al. ..... 415/206
7,001,149 B1 * 2/2006 Waggoner et al. ..... 415/204
7,029,244 B2 * 4/2006 Anderson ..... 417/362
7,036,498 B2 * 5/2006 Riepenhoff et al. ..... 126/110 R
7,096,933 B1 * 8/2006 Zia et al. ..... 165/170
7,118,355 B2 * 10/2006 Lipa et al. ..... 417/370
7,170,038 B2 * 1/2007 Butler ..... 219/634
7,182,574 B2 * 2/2007 Lyons ..... 415/213.1
7,210,903 B2 * 5/2007 Lyons ..... 415/204
7,217,098 B2 * 5/2007 Lim ..... 416/100
7,241,110 B2 * 7/2007 Chang et al. ..... 415/184
7,278,823 B2 * 10/2007 Platz ..... 415/204
7,359,629 B2 * 4/2008 Butler et al. ..... 392/356
RE40,818 E * 7/2009 Gatley, Jr. ..... 110/162
7,579,574 B2 * 8/2009 Butler ..... 219/553
2001/0038794 A1 * 11/2001 Stewart ..... 417/53
2002/0014233 A1 * 2/2002 Gatley et al. ..... 126/110 R
2002/0048738 A1 * 4/2002 Garloch et al. ..... 431/75
2002/0178980 A1 * 12/2002 Gatley, Jr. ..... 110/182.5
2004/0180305 A1 * 9/2004 Dempsey et al. ..... 431/139
2005/0019159 A1 * 1/2005 Lyons et al. ..... 415/213.1
2005/0042078 A1 * 2/2005 Sturgell ..... 415/128
2005/0126558 A1 * 6/2005 Riepenhoff et al. ..... 126/110 R
2006/0024160 A1 * 2/2006 Horng et al. ..... 415/206
2006/0038106 A1 * 2/2006 Geroux et al. ..... 248/603
2006/0051204 A1 * 3/2006 Lyons ..... 415/204
2006/0051205 A1 * 3/2006 Platz ..... 415/206
2006/0051206 A1 * 3/2006 Lyons ..... 415/206
2006/0099072 A1 * 5/2006 Lyons ..... 415/214.1
2007/0272228 A1 * 11/2007 Slaby ..... 126/104 A

* cited by examiner

DRAFT INDUCER BLOWER MOUNTING FEATURE WHICH REDUCES OVERALL SYSTEM VIBRATION

BACKGROUND OF THE INVENTION

1. Field of the Invention

The present invention relates to air moving devices, and in particular, to blowers of the type which are used with high efficiency, e.g., 90% or higher efficiency, furnaces for drawing air from outside of a building into the furnace to support combustion and to expel combustion exhaust products outside of the building. More particularly, the present invention relates to a blower mounting feature which reduces system vibration.

2. Description of the Related Art

In high efficiency furnaces, standard chimney air-draw effects are not sufficient to assure the required air flow through the furnace heat exchangers, and therefore, high efficiency furnaces utilize draft inducer blowers to provide sufficient air flow through the furnace. In particular, the blowers of high efficiency furnaces pull flue gases through the furnace heat exchangers and then push the flue gases out through exhaust piping to the exterior of the building.

Existing furnaces include a wall or collector box having a standard arrangement of mounting holes which are configured in a generally circular pattern about an exhaust opening in the wall. A blower housing is attached to the wall using a plurality of fasteners, typically threaded bolts or screws, which are inserted through mounting lugs in the blower housing and into the mounting holes in the collector box. Typically, the mounting lugs of the blower housing include slot-like openings through which the fasteners are inserted, wherein the elongated, slot-like or round shape of the openings permit a limited amount of adjustment with respect to the positioning of the fasteners.

The collector box is normally pan shaped in molded construction. A seal is required between the draft inducer blower inlet and the collector box. In some cases, the seal is built concavely into the inlet of the blower allowing for the mounting points of the blower to be on the same plane as the inlet side of the blower. This allows for maximum contact of blower to collector box which effectively ties the two parts together stiffening the system and reducing vibration.

One known blower for a high efficiency furnace is shown in FIGS. 1-2, and generally includes a blower housing 20 having a housing body 22 and a housing cover 24, the construction and design of which are fully described in co-pending U.S. patent application Ser. No. 10/934,004, filed Sep. 3, 2004, titled DRAFT INDUCER BLOWER; U.S. patent application Ser. No. 10/982,454, filed Nov. 5, 2004, titled DRAFT INDUCER BLOWER WITH FASTENER RETENTION; U.S. patent application Ser. No. 10/994,963, filed Nov. 22, 2004, titled LOBED JOINT DRAFT INDUCER BLOWER; and U.S. patent application Ser. No. 10/934,070, filed Sep. 3, 2004, titled LOBED JOINT DRAFT INDUCER BLOWER, all assigned to the assignee of the present application, the disclosures of which are expressly incorporated herein by reference. Housing body 22 may be formed as a molded plastic component, having a cylindrical outer wall 26, a planar top wall 28, and an axially recessed, planar wall 30 to which electric motor 32 is mounted. Housing body 22 further includes an integral, tubular exhaust transition 34 and outlet projecting tangentially therefrom, to which an exhaust pipe (not shown) is connected. Housing cover 24 may be a substantially flat, molded plastic circular plate and is attached to housing body 22 by being captured between housing body 22 and wall or collector box 36 of a furnace, as shown in FIG. 2. Specifically, after blower housing 20 is positioned near the collector box 36 as shown in the left side of FIG. 2, a plurality of bolts 38 are inserted through respective mounting lugs 40 in housing body 22 and into a set of corresponding holes 42 in collector box 36 to thereby attach the blower housing 20 to the furnace, as shown in the right side of FIG. 2. Alternatively, fasteners 38 may be inserted through auxiliary mounting lugs 40' in addition to or as an alternative to mounting lugs 40. Holes 42 in collector box 36 are disposed in a standard pattern with a predetermined, fixed diameter.

An impeller 44, shown in FIG. 2, is disposed within the interior of blower housing 20 between housing body 22 and housing cover 24, and is mounted for rotation upon drive shaft 46 of motor 32. In operation, rotation of impeller 44 by motor 32 draws exhaust gases through a centrally disposed circular inlet 48 in housing cover 24 from the furnace into the blower housing 20, and the exhaust gases are discharged through the outlet of exhaust transition 34. Although the foregoing blower housing has proven to be effective for use with high efficiency furnaces, improvements to same are desired.

Referring now to FIG. 3, collector box 36 of a furnace is shown including four holes 42 and exhaust opening 54 as well as gasket 52 (FIG. 2) disposed between collector box 36 and blower housing 20 when fully assembled. Collector box 36 includes side walls 69, top wall 37, and flange 65. Flange 65 may be used to secure collector box 36 to a furnace wall (not shown) with a plurality of fasteners (not shown). Wall 37 generally extends across the top of collector box 36. Side walls 69 provide structural strength to collector box 36. Collector box 36 typically includes at least two extensions 74 which facilitate mounting blower housing 20 to collector box 36. Each extension 74 includes one of the four holes 42 provided in collector box 36. Collector box 36 may be separately attached to a furnace wall of a furnace or blower housing 20 may be directly attached to the furnace wall. Collector box 36 is generally shaped as a rectangular body of glass-filled molded plastic, for example.

When blower housing 20 (FIGS. 1-2) is attached to collector box 36 via a plurality of bolts 38 (FIGS. 1-2), the only points of contact between the blower housing 20 and collector box 36 are between contact surfaces 41 (FIG. 2) of mounting lugs 40 and wall 37 of collector box 36, denoted by ghost lines in FIG. 3 as contact areas 60. Contact areas 60 define only four discrete points or areas of rigid contact between box 36 and housing 20. Gasket 52 provides a seal between collector box 36 and blower housing 20, but does not enhance the rigid contact between box 36 and housing 20.

Wall 37 of collector box 36 is relatively thin and, due to the pan-type shape of collector box 36, collector box 36 may potentially flex in a twisting manner and/or wall 37 of collector box 36 may bow and flex wherein vibration may be transferred from the motor of blower housing 20 to collector box 36 during running of the blower, causing vibration, flexing, or twisting movement of collector box 36 which can generate resonance noise.

What is needed is a draft inducer blower housing for high efficiency furnaces which is an improvement on the foregoing.

SUMMARY OF THE INVENTION

The present invention provides a draft inducer blower for high efficiency furnaces, including a blower housing which provides enhanced contact between the blower housing and the furnace collector box to reduce the flexing and vibration between the blower housing and the collector box. The blower housing includes contact structure which provides a direct abutting contact relationship between the blower housing and the collector box at least along a substantial periphery of the blower housing and/or at one or more rigid transition points on the collector box. In one embodiment, the contact structure can be part of the blower housing body and/or the blower housing cover. In another embodiment, the contact structure can be part of the collector box or furnace to which the blower housing is mounted. When fasteners secure the blower housing to the collector box, the contact structure provides a substantially integral rigid construct between the blower housing and the collector box.

The contact structure extends from the blower housing or the collector box and abuts the collector box or blower housing, respectively. These contact areas may be defined proximate the mounting bolt diameter or they may be defined substantially radially inward of the mounting bolt diameter. Alternatively, the contact areas may be defined outside the mounting bolt diameter depending on a desired application. The contact areas may include, for example, a plurality of continuous concentric ridges, a plurality of discontinuous concentric ridges, at least one discrete protuberance, at least one continuous ridge, at least one discontinuous ridge, or any combination thereof.

Advantageously, the present invention provides a draft inducer blower which results in a quieter high efficiency furnace system with reduced vibration and resonance levels. The draft inducer blower advantageously includes a direct abutting contact relationship between the blower housing and the collector box along a substantial portion of the periphery of the blower housing wherein, when the blower housing is attached to the collector box via fasteners, a substantially integral rigid construct is formed between the blower housing and the collector box to reduce vibration of the furnace.

In one form thereof, the present invention provides a blower housing defining perpendicular axial and radial directions, including a housing body including a top wall, a side wall, and a plurality of mounting lugs disposed around the side wall; a housing cover including a bottom wall, the housing cover fittable to the housing body with the mounting lugs extending in the axial direction beyond the housing cover bottom wall; and at least one contact structure integrally formed with one of the housing body and the housing cover, the contact structure extending in the axial direction a distance equal to or greater than the mounting lugs.

In another form thereof, the present invention provides a blower housing defining perpendicular axial and radial directions, including a housing body including a top wall, a side wall, and a plurality of mounting lugs disposed around the side wall, each mounting lug including an opening; a housing cover including a bottom wall, the housing cover fittable to the housing body; at least one contact structure integrally formed with one of the housing body and the housing cover, the contact structure disposed at least in part radially inwardly of the openings of the mounting lugs; and a plurality of fasteners insertable through respective openings of the mounting lugs, the fasteners extendable in the axial direction beyond the mounting lugs and the contact structure.

In yet another form thereof, the present invention provides a blower housing having an outer periphery and a bottom wall, the blower housing attachable to a furnace wall, the blower housing including a plurality of mounting lugs disposed around the blower housing outer periphery; and at least one contact structure extending from the blower housing bottom wall and which, when the blower housing is attached to the furnace wall, directly abuts the furnace wall around a substantial extent of the blower housing outer periphery.

In still another form thereof, the present invention provides, in combination, a furnace, including a wall having a plurality of mounting holes therein; and a blower housing defining perpendicular axial and radial directions, including a housing body having a plurality of mounting lugs; a plurality of fasteners extending through respective mounting lugs and into respective mounting holes; and a housing cover fittable to the housing body, the housing cover including contact structure disposed at least in part radially inwardly of the fasteners and extending in the axial direction from the housing cover into direct abutment with the furnace wall.

In another form thereof, the present invention provides, in combination, a furnace, including a wall having a plurality of mounting holes therein; and a blower housing defining perpendicular axial and radial directions, including a housing body having a plurality of mounting lugs; a plurality of fasteners extending through respective mounting lugs and into respective mounting holes; and contact structure integrally formed with the housing body and disposed at least in part circumferentially in between respective pairs of mounting lugs, the contact structure extending in the axial direction from the housing body into direct abutment with the furnace wall.

In yet another form thereof, the present invention provides, in combination, a furnace collector box, including a top wall including a plurality of mounting holes therein; at least a pair of side walls depending from the top wall; and a blower housing defining perpendicular axial and radial directions, including a housing body having a plurality of mounting lugs; a plurality of fasteners extending through respective mounting lugs and into respective mounting holes; and contact structure extending from the blower housing into direct abutment with the top wall in at least two locations adjacent the side walls.

In a further form thereof, the present invention provides, in combination, a blower housing; and a furnace collector box, including a top wall including a plurality of mounting holes therein; and contact structure integrally formed with the top wall and extending from the top wall into direct abutment with the blower housing.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention, and such exemplifications are not to be construed as limiting the scope of the invention in any manner.

DETAILED DESCRIPTION

Figure 4:
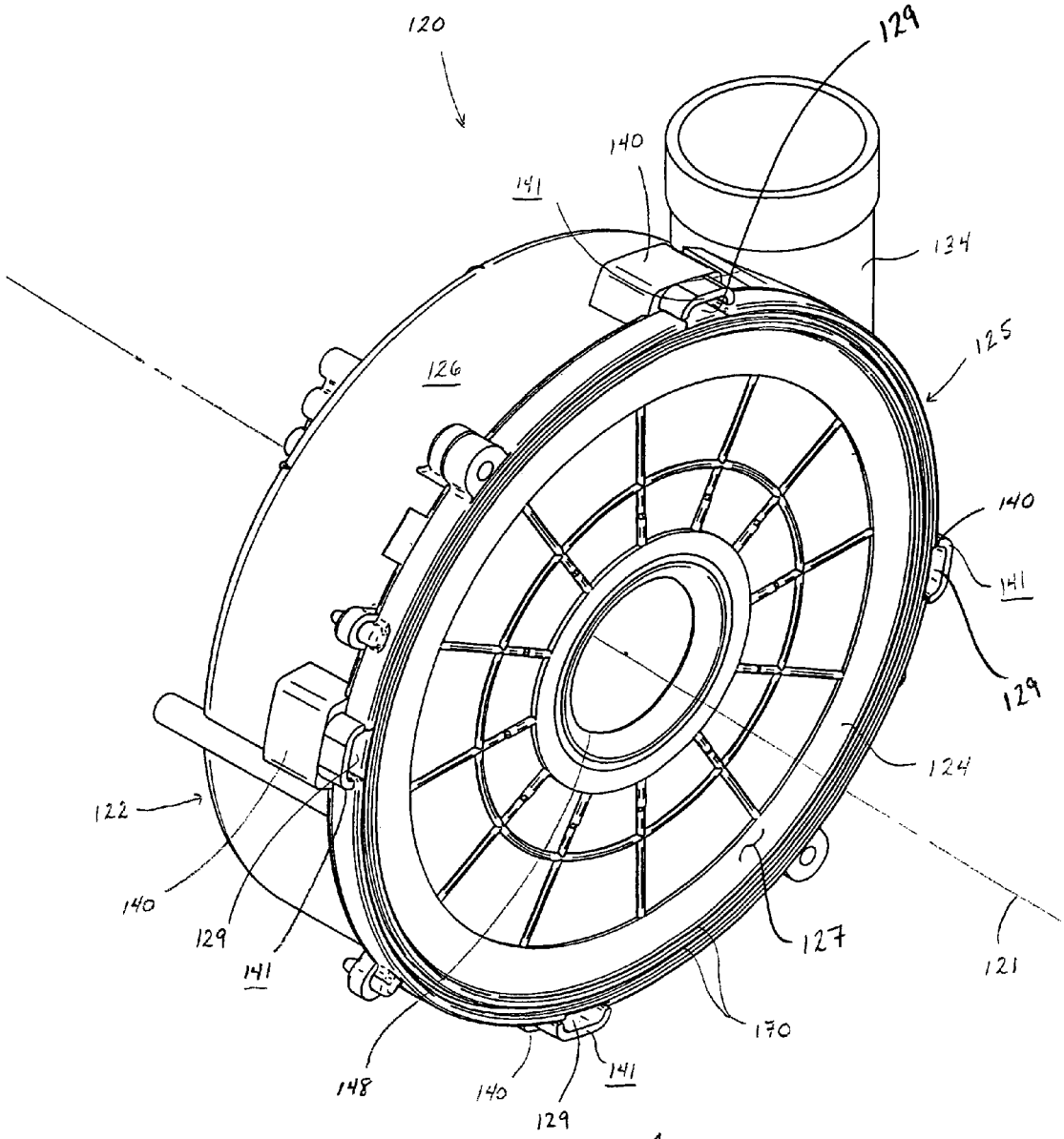
FIG. 4 is a perspective view of a blower housing according to one embodiment of the present invention.
Figure 5:
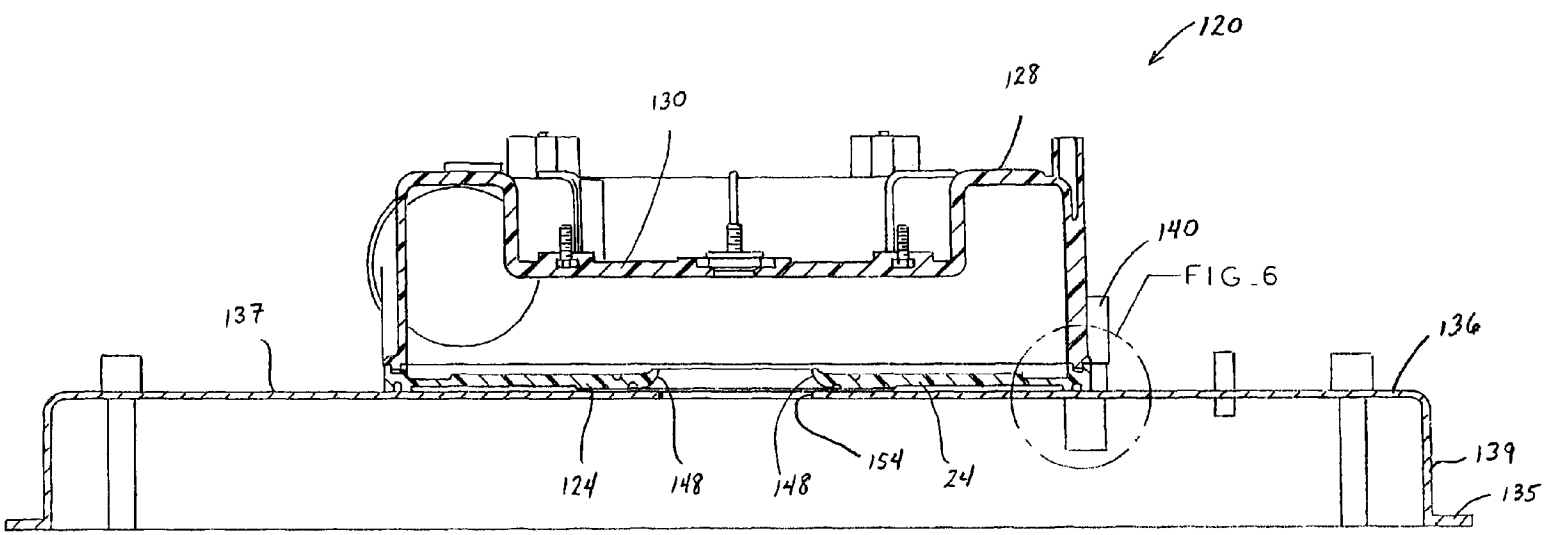
FIG. 5 is a sectional view through the blower housing of FIG. 4 and the furnace collector box of FIG. 8.

Referring now to FIG. 4, a draft inducer blower in accordance with the present invention is shown and generally includes a blower housing 120 having a housing body 122 and a housing cover 124. Blower housing 120 defines central axis 121 to define an axial direction, i.e., along central axis 121, and a radial direction perpendicular to the axial direction. Housing body 122 may be formed as a molded plastic component, having a cylindrical outer or side wall 126, a planar top wall 128 (FIG. 5), and an axially recessed, planar wall 130 (FIG. 5) to which an electric motor (not shown) is mounted. Housing body 122 includes a plurality of mounting lugs 140 disposed around side wall 126. Housing body 122 further includes an integral, tubular exhaust transition 134 and outlet projecting tangentially therefrom, to which an exhaust pipe (not shown) is connected. Housing cover 124 includes bottom wall 127 and is a substantially flat, molded plastic circular plate which is fittable to housing body 122 with mounting lugs 140 extending in the axial direction beyond bottom wall 127. Housing cover 124 may be captured between housing body 122 and collector box 136 of a furnace, as shown in FIG. 5, when blower housing 120 is attached to collector box 136 in the manner described below. Collector box 136 is part of an exemplary furnace and may be separately attached to a wall of the furnace. In other furnaces, blower housing 120 may be directly connected to a furnace wall or to other suitable furnace structure. Collector box 136 is generally shaped as a rectangular body of glass-filled molded plastic, for example, or a stamped metal construction, for example.

Figure 8:
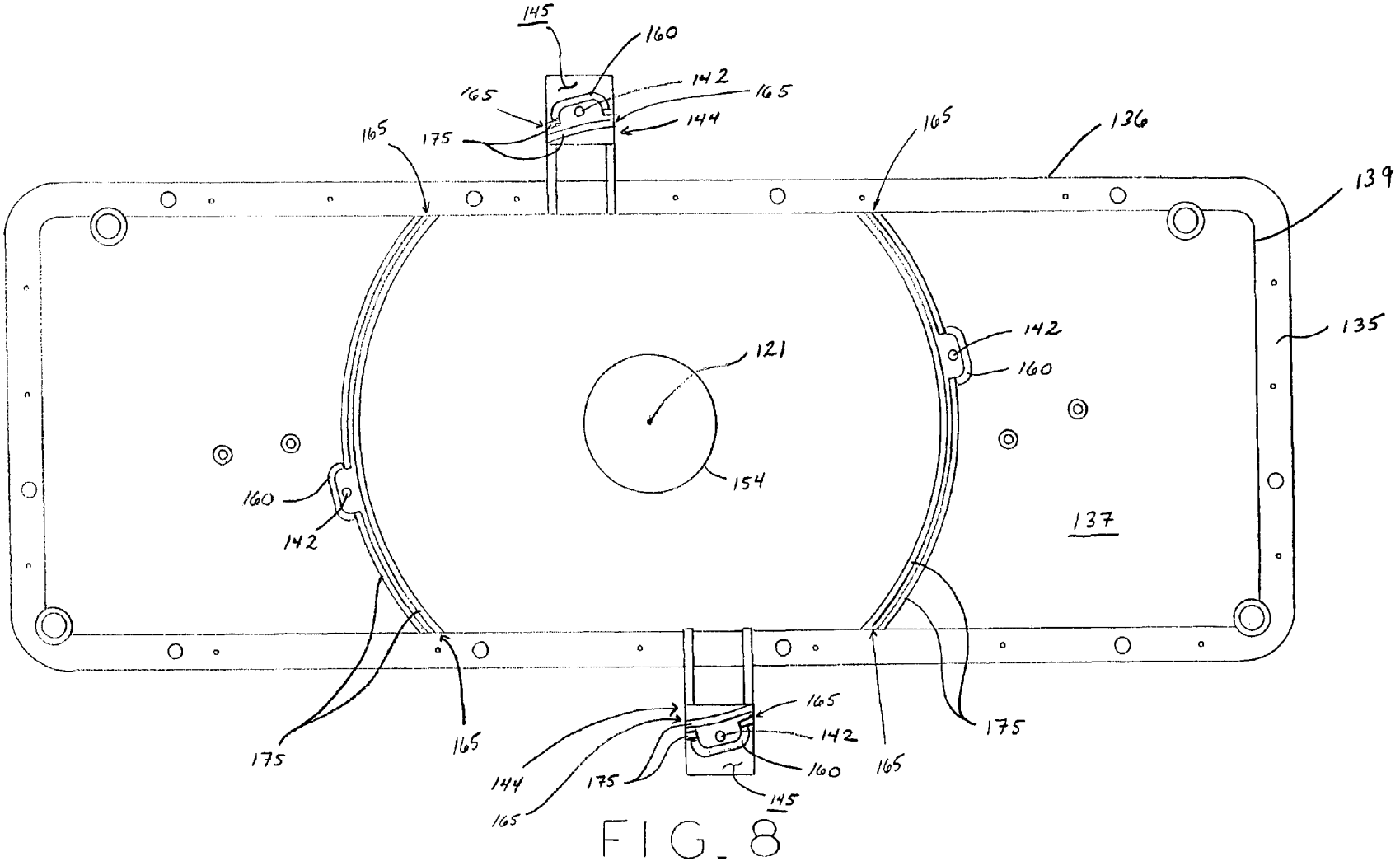
FIG. 8 is a plan view of the collector box, showing a series of solid lines representing the contact areas between the blower housing of FIG. 4 and the collector box.

As shown in FIGS. 5 and 8, collector box 136 includes side walls 139, top wall 137, and flange 135. Flange 135 may be used to secure collector box 136 to a furnace wall (not shown) with a plurality of fasteners (not shown). Wall 137 generally extends across the top of collector box 136, as shown in FIG. 8. Side walls 139 provide structural strength to collector box 136 through flange 135. Collector box 136 includes four mounting holes 142 and exhaust opening 154 with mounting holes 142 arranged in a predetermined spaced manner in a circular pattern. As shown in FIG. 8, holes 142 in collector box 136 are disposed in a standard pattern with a predetermined, fixed diameter. Collector box 136 also includes at least two extensions 144 which facilitate mounting blower housing 120 to collector box 136. Each extension 144 includes one of the four holes 142 provided in collector box 136.

Housing cover 124 includes outer periphery 125 which may be formed as a generally circular shape. In one embodiment, housing cover 124 has a diameter substantially defined by outer periphery 125 (FIG. 4) which substantially corresponds to the diameter defined by a circle connecting holes 142 (FIG. 8) in collector box 136. Specifically, after blower housing 120 is positioned near the collector box 136 as shown in FIG. 5, a plurality of fasteners (not shown, but substantially similar to bolts 38 shown in FIGS. 1-2) are inserted through openings 129 in respective mounting lugs 140 in housing body 122 and into a set of corresponding holes 142 (FIG. 8) in collector box 136. The fasteners are extendable beyond mounting lugs 140 and contact structure, described below and shown in FIGS. 4-6 and 9 as ridges 170 to attach blower housing 120 to the furnace.

As described below with respect to FIGS. 4-14, the present invention provides a draft inducer blower for high efficiency furnaces, including a blower housing which provides enhanced contact between the blower housing and the furnace collector box to reduce relative movement, such as flexing and vibrational movement, between the blower housing and the collector box. In one embodiment, either or both of the housing body or the housing cover of the blower housing includes contact structure which provides a substantial, direct abutting contacting relationship between the blower housing and the collector box at least along a substantial periphery of the blower housing and/or at one or more rigid transition points on the collector box. In another embodiment, the collector box includes contact structure which provides a substantial, direct abutting contacting relationship between the blower housing and the collector box at least along a substantial periphery of the blower housing and/or at one or more rigid transition points on the collector box. When fasteners secure the blower housing to the collector box, the contact structure provides a substantially integral, rigid and immovable construct between the blower housing and the collector box.

Figure 6:
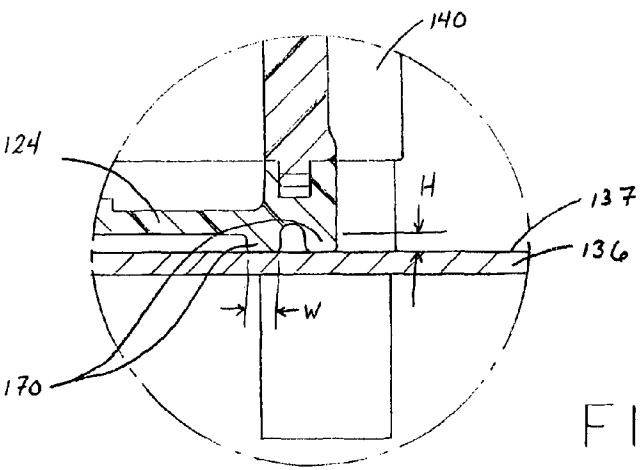
FIG. 6 is a fragmentary sectional view of a portion of FIG. 5, showing the contact between the blower housing and the collector box from the contact structure extending from the blower housing.
Figure 9:
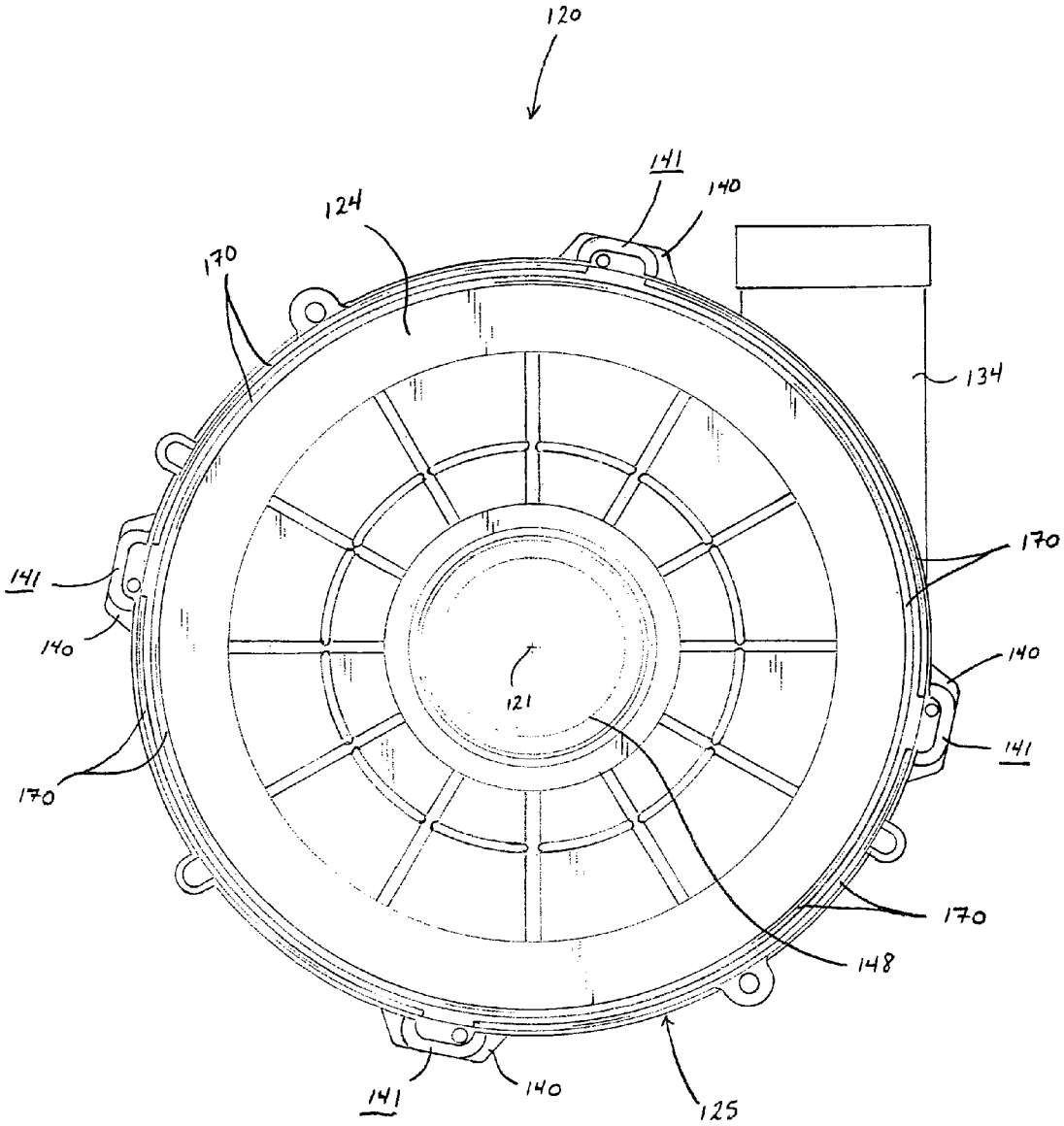
FIG. 9 is a plan view of the blower housing of FIG. 4, showing the layout of the contact structure on the housing cover.

Referring now to FIGS. 4 and 9, blower housing 120 includes exemplary contact structure in the form of two concentric partial rails or ridges 170 on housing cover 124, each ridge 170 concentric about central axis 121. Ridges 170 may be made of similar material as housing cover 124 and formed integrally/monolithically therewith, such as by co-molding, or may be formed separately of housing cover 124 and attached thereto in a suitable manner. As best shown in FIG. 9, ridges 170 extend at least partially circumferentially around housing cover 124, for example, ridges 170 are discontinuous near mounting lugs 140 but remain continuous throughout the remainder of the circumference of housing cover 124. Ridges 170 also axially extend from cover 124 at least a distance equal to or greater than mounting lugs 140. As shown in FIG. 6, for example, ridges 170 may extend a distance H of approximately 0.15 in., 0.25 in., 0.30 in., or 0.35 in. to as much as 0.75 in., 0.85 in., or 0.95 in. Distance H may be chosen to be approximately equal to, or just greater than, the distance that mounting lugs 140 axially outwardly extend from housing cover 124 when assembled. Ridges 170 may have a radially extending width W of approximately 0.125 in., and, alternatively may have a width of approximately 0.100 in., 0.110 in., or 0.120 in. to as much as 0.150 in., 0.175 in., or 0.200 in. In one embodiment, ridges 170 may each have varying widths. Alternatively, ridges 170 may include discontinuities or breaks elsewhere around the circumference, i.e., at a location distant from mounting lugs 140, or may be continuous throughout the entire circumference, i.e., with no discontinuity near each mounting lug 140.

Ridges 170 may be disposed adjacent outer periphery 125 of housing 120. Alternatively, if housing cover 124 extends beyond the circle connecting holes 142, then outer periphery 125 may be defined by the general circular outline of mounting holes 142 (FIG. 8) in collector box 136. In such a configuration, ridges 170 may be disposed substantially radially inward of outer periphery 125, i.e., towards central axis 121 and substantially radially inward of the general circular outline of mounting holes 142 or openings 129 of mounting lugs 140, or substantially radially outward of outer periphery 125, i.e., substantially radially outward of the general circular outline of mounting holes 142.

Alternatively, cover 124 may include only a single ridge 170 which is either continuous or discontinuous similar to ridges 170, described above. In yet another alternative embodiment, ridges 170 are randomly arranged on cover 124 and may include more than two single ridges. In another alternative embodiment, ridges 170 are non-concentric. Ridges 170 may also be non-circular, for example, elliptical, rectangular, etc.

Figure 3:
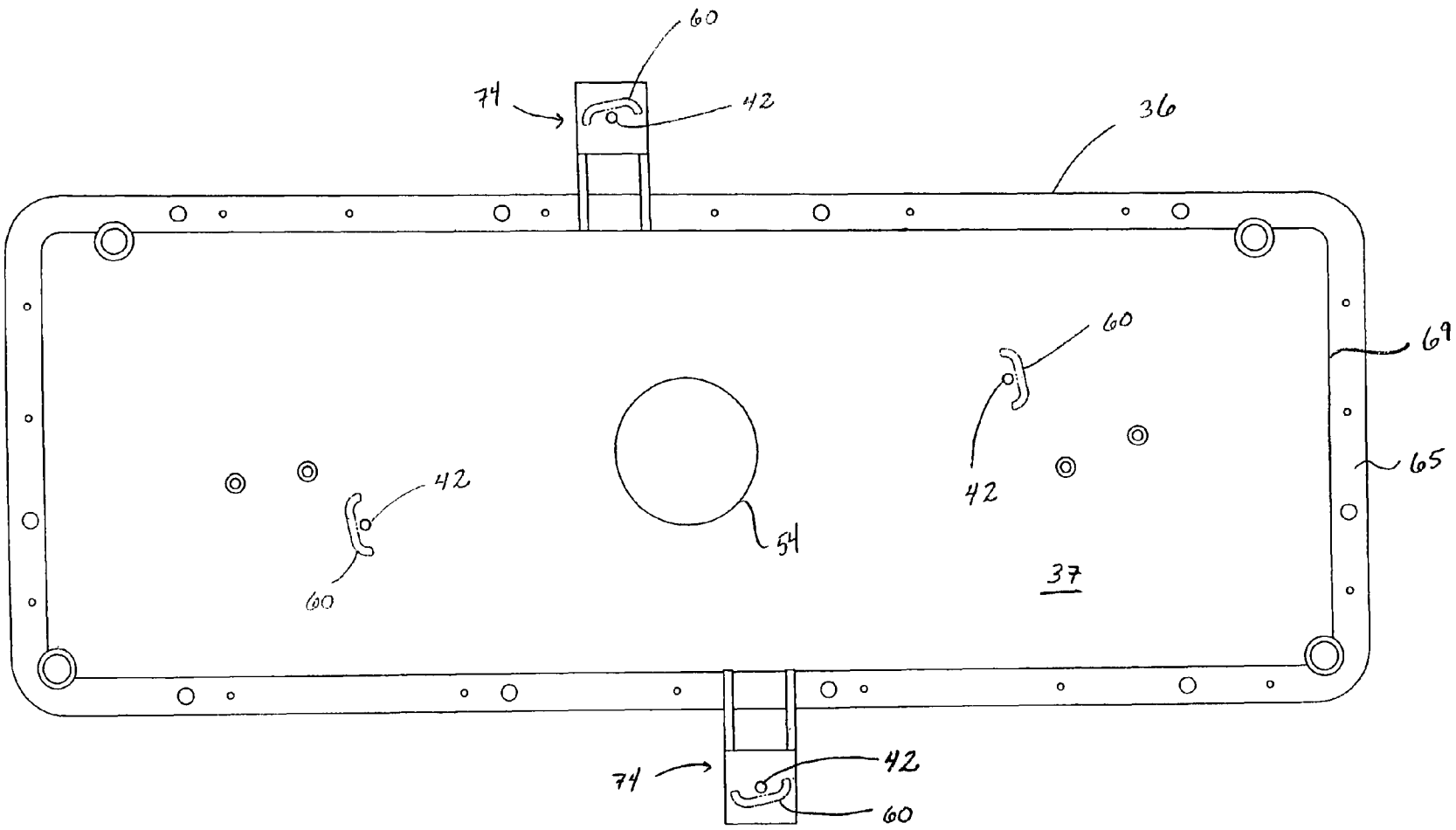
FIG. 3 PRIOR ART
FIG. 3 is a plan view of the collector box of FIG. 2, showing the contact areas between the blower housing and the collector box.

Referring now to FIG. 8, when blower housing 120 (FIGS. 5-6) is attached to collector box or wall 136 via a plurality of bolts (not shown), ridges 170 provide a substantially increased amount of contact between collector box 136 and blower housing 120, as shown by ghost lines in FIG. 8 as contact areas 175 and contact areas 160. Contact areas 175 and contact areas 160 provide the increased amount, or area, of contact as compared to contact areas 60 (FIG. 3). Contact areas 175 are represented in FIG. 8 as solid lines on wall 137 of collector box 136 and on surfaces 145 of extensions 144 of collector box 136. The substantial amount, or area, of contact between collector box 136 and blower housing 120 reduces the potential for movement between blower housing 120 and collector box 136, flexing of housing 120 with respect to collector box 136, etc., thereby reducing vibration between blower housing 120 and collector box 136 during use and reducing or eliminating the resonance created from such vibration.

Referring again to FIG. 8, in an exemplary embodiment, collector box 136 may include at least eight transition points 165, or more or less transition points, depending on the shape or configuration of collector box 136. A transition point is defined by a structurally rigid area of collector box 136, such as an edge of collector box 136 and/or extensions 144, for example, four transition points 165 are shown in FIG. 8 at four edges of wall 137 and two transition points 165 are located at edges of surface 145 on each extension 144. Transition points 165 are generally the strongest locations on collector box 136 because loads may be transferred at transition points 165 through side walls 139 of collector box 136 to flange 135 thereof. Extensions 144 are also generally the strongest locations on collector box 136 due to reinforcement from support structure 147 (FIG. 13), for example. To further enhance the reduction of vibration and elimination of resonance created therefrom, ridges 170 may contact collector box 136 at transition points 165, as shown by contact areas 175 in FIG. 8. In one embodiment, ridges 170 may be reduced to provide only direct contact at transition points 165 to still provide the desired rigid construct.

Figure 10:
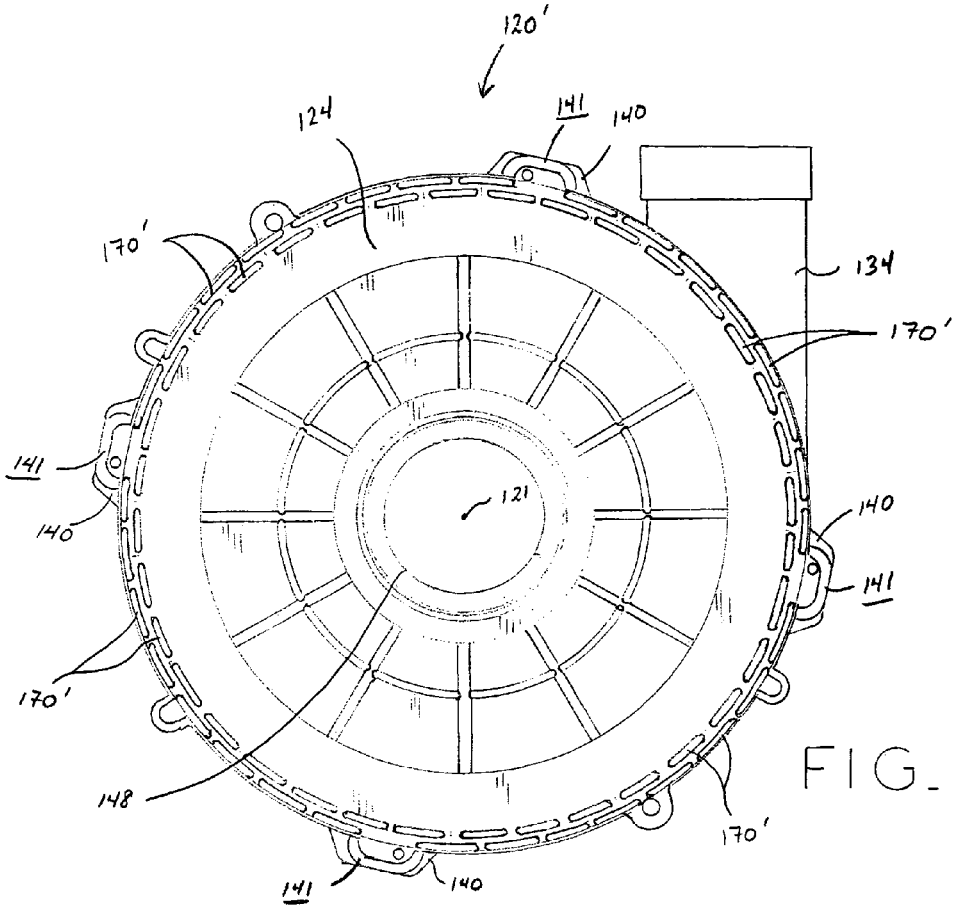
FIG. 10 is a plan view of the blower housing of FIG. 4, showing an alternative layout of the contact structure on the housing cover.

In an alternative embodiment shown in FIG. 10, blower housing 120' may include exemplary contact structure in the form of a plurality of concentric, discontinuous ridges 170'. Ridges 170' may be made of similar material as housing cover 124 and formed integrally/monolithically therewith, such as by co-molding, or may be formed separately of housing cover 124 and attached thereto in a suitable manner. Ridges 170' have a plurality of discontinuities around the circumference thereof. In an exemplary embodiment, ridges 170' contact collector box 136 at least at transition points 165, described above. In an alternative embodiment, ridges 170' may comprise a single discontinuous ridge or more than two concentric discontinuous ridges. In another alternative embodiment, ridges 170' are non-concentric. Ridges 170' may also be non-circular, for example, elliptical, rectangular, etc. Ridges 170' may be made of similar material as housing cover 124 and formed integrally therewith.

Figure 11:
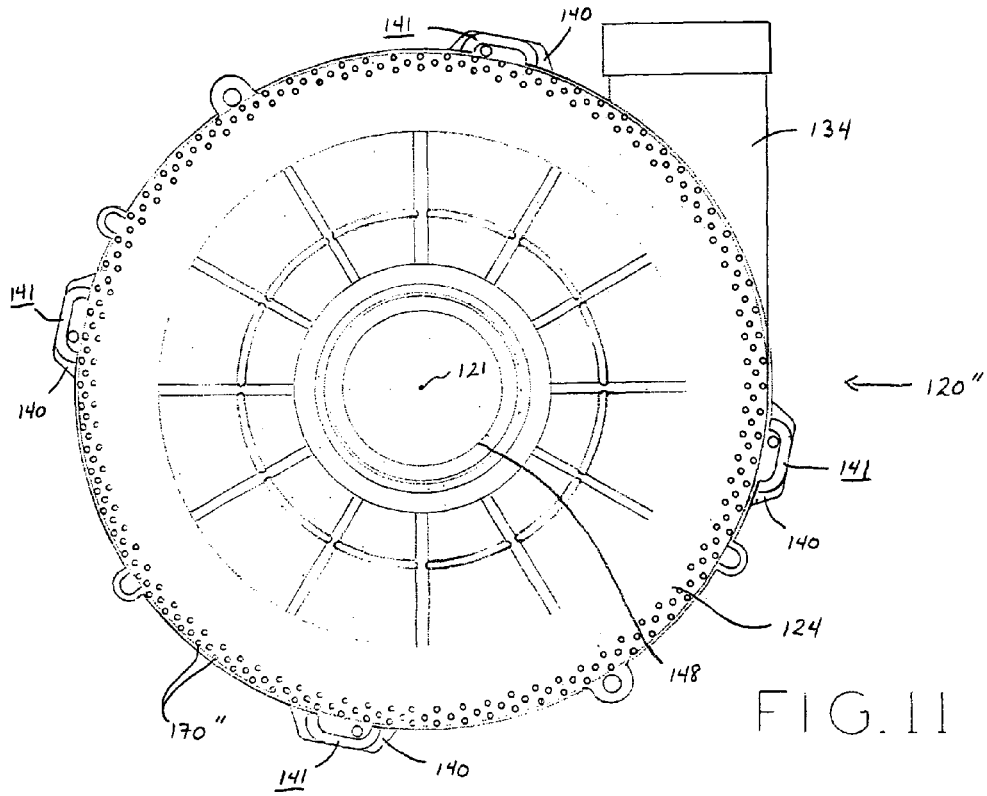
FIG. 11 is a plan view of the blower housing of FIG. 4, showing a still further alternative layout of the contact structure on the housing cover.

In an alternative embodiment shown in FIG. 11, blower housing 120" may include exemplary contact structure in the form of a plurality of discrete bumps or protuberances 170". Ridges 170" may be made of similar material as housing cover 124 and formed integrally/monolithically therewith, such as by co-molding, or may be formed separately of housing cover 124 and attached thereto in a suitable manner. In an exemplary embodiment, at least some of protuberances 170" contact collector box 136 at least at transition points 165, described above. Bumps 170" may generally be formed in a single circular line, a plurality of concentric circular lines, a plurality of non-concentric circular lines, or randomly arranged. Bumps 170" may be made of similar material as housing cover 124 and formed integrally therewith.

Figure 12:
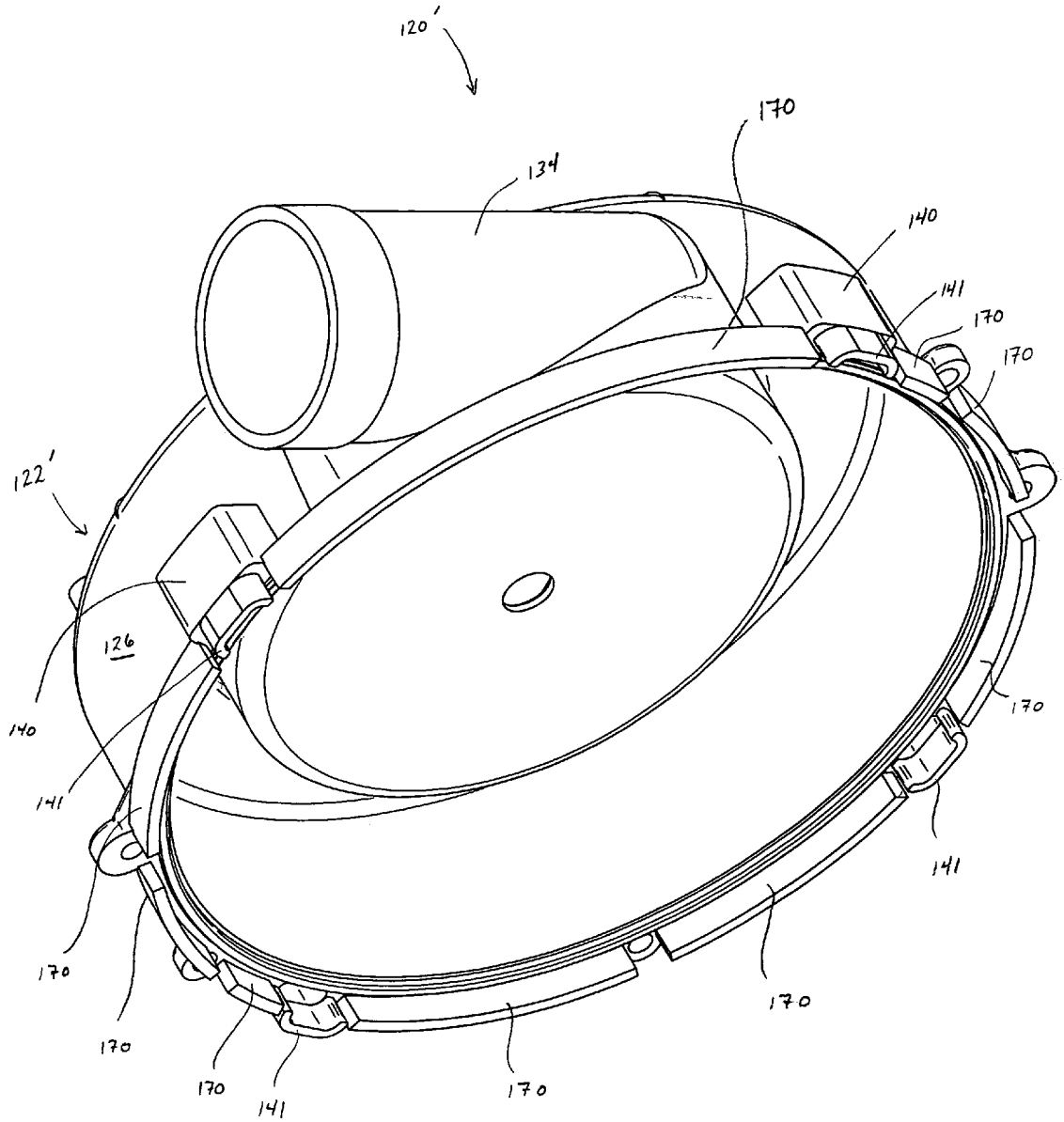
FIG. 12 is a perspective view of an alternative embodiment blower housing, showing the contact structure extending from the blower housing body.

Although the foregoing description described exemplary contact structure extending from housing cover 124, in an alternative embodiment, shown in FIG. 12, exemplary contact structure, such as ridges 170, may also extend from housing body 122' of blower housing 120'. Ridges 170 on housing body 122' may be made of similar material as housing body 122' and formed integrally/monolithically therewith, such as by co-molding, or may be formed separately and attached thereto in a suitable manner. Similar to ridges 170 on housing cover 124 described above with respect to FIGS. 4-6 and 8-11, ridges 170 on housing body 122' provide a substantial, direct abutting contacting relationship between blower housing 120' and collector box 136 at least along a substantial periphery of blower housing 120' and/or at one or more rigid transition points 165 (FIG. 8) on collector box 136. Ridges 170 may axially extend from body 122' at least a distance equal to or greater than mounting lugs 140. Ridges 170 on body 122' may be disposed at least in part circumferentially in between respective pairs of mounting lugs 140.

Figure 13:
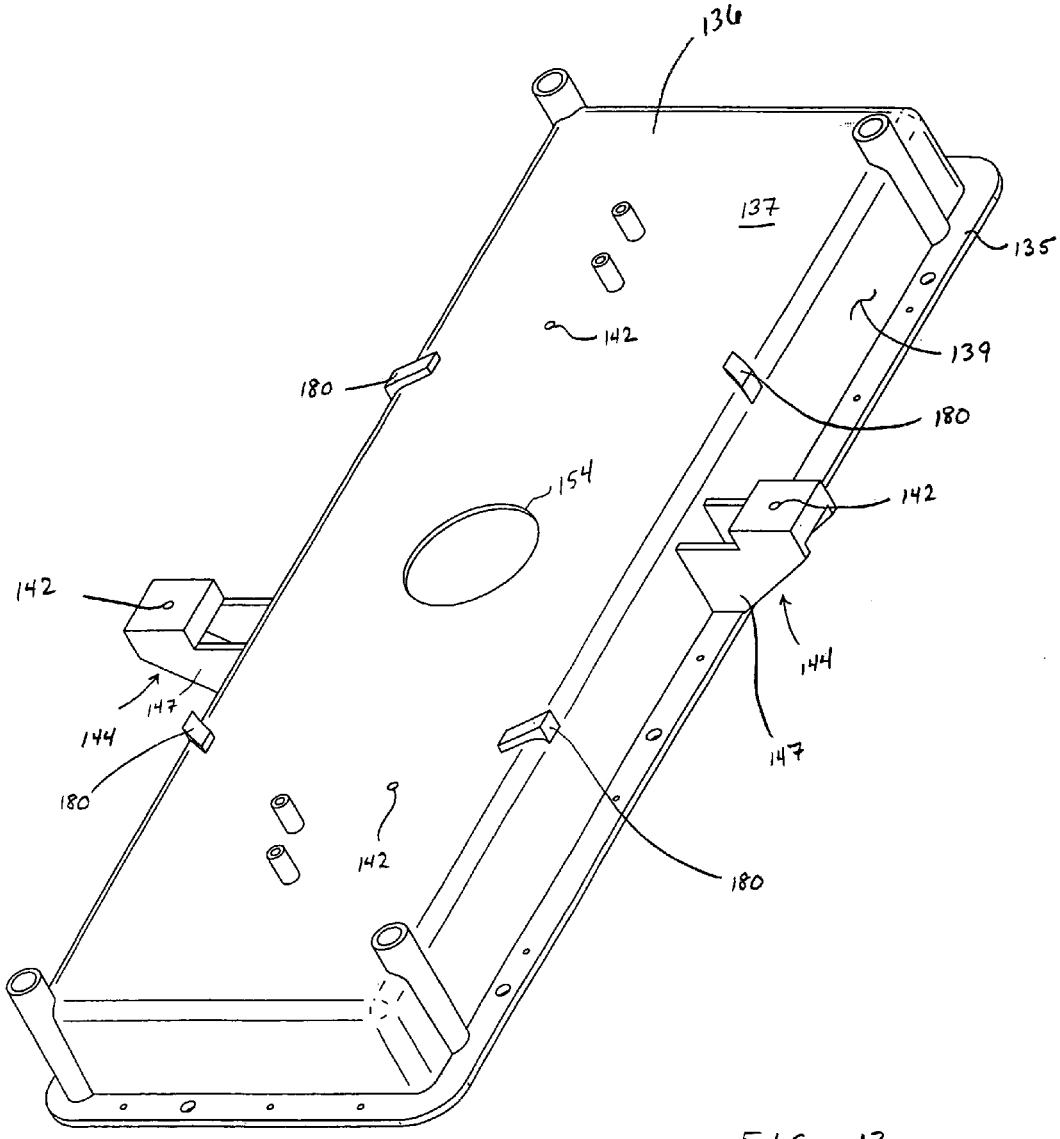
FIG. 13 is a perspective view of an alternative embodiment collector box, showing a plurality of protuberances extending from the top wall adjacent the side walls of the collector box.

In another embodiment, to enhance the stability of blower housing 120, 120', or 120", exemplary contact structure, such as protuberances 180, shown in FIG. 13, may be included on collector box 136. Protuberances 180 may extend from collector box 136 towards blower housing 120 to provide enhanced contact at transition points 165 between blower housing 120 and collector box 136. Protuberances 180 may be integrally/monolithically formed with collector box, such as co-molding, or may be separately attached to collector box 136. Alternatively, protuberances 180 may be stamped into collector box 136, for example, when collector box 136 is formed of metal. Similar to ridges 170 on housing cover 124 described above with respect to FIGS. 4-6 and 8-11, protuberances 180 on collector box 136 provide a substantial, direct abutting contacting relationship between blower housing 120 and collector box 136 at least along a substantial periphery of blower housing 120 and/or at one or more rigid transition points 165 (FIG. 8) on collector box 136.

Figure 7:
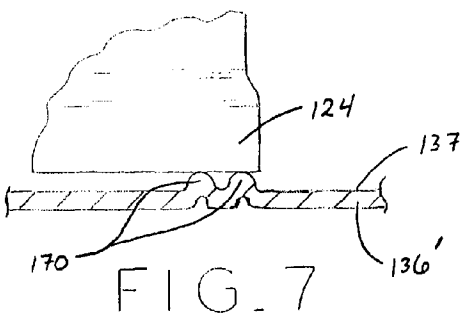
FIG. 7 is a fragmentary sectional view of a portion of an alternative embodiment of FIG. 5, showing the contact between the blower housing and the collector box from the contact structure extending from the collector box.
Figure 14:
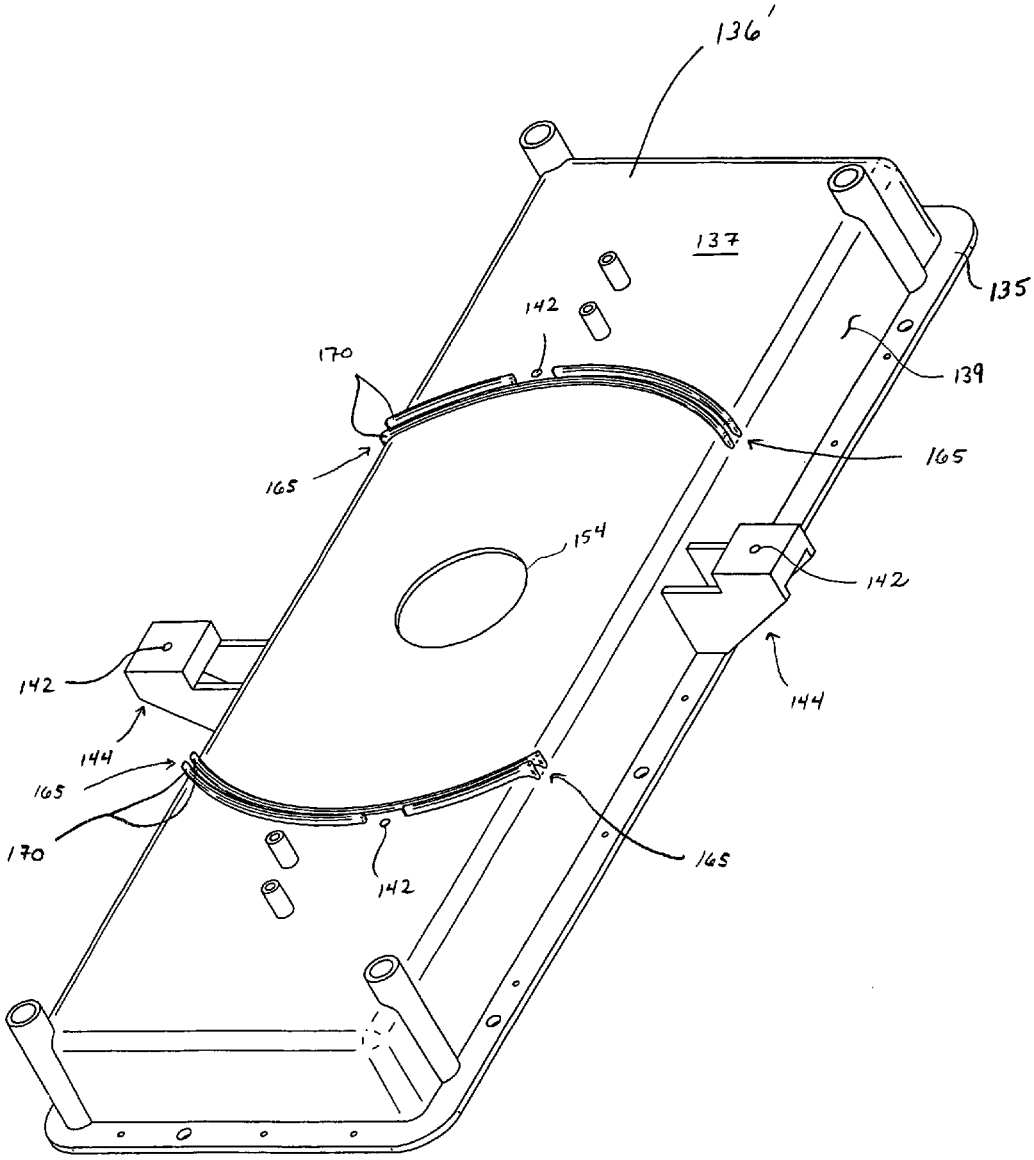
FIG. 14 is a perspective view of an alternative embodiment collector box, showing the contact structure extending from the collector box.

In one embodiment, shown in FIG. 7, contact structure in the form of ridges 170 may axially outwardly extend from collector box 136' and contact housing cover 124. In one embodiment, ridges 170 may be formed by stamping the sheet metal used to form collector box 136' or by molding ridges 170 directly into collector box 136'. As shown in FIG. 14, ridges 170 may take the same or similar form as ridges 170 on housing cover 124, described above. Similar to ridges 170 on housing cover 124 described above with respect to FIGS. 4-6 and 8-11, ridges 170 on collector box 136' provide a substantial, direct abutting contacting relationship between blower housing 120 and collector box 136' at least along a substantial periphery of blower housing 120 and/or at one or more rigid transition points 165 (FIG. 8) on collector box 136'.

The following non-limiting Example illustrates various features and characteristics of the present invention which are associated with the use of mounting features on draft inducer blower arrangements to reduce vibration and noise and which are not to be construed as limited thereto.

Example 1

In a typical furnace, the 56 Hz frequency resonance of the furnace produces a low drone, pure tone noise in the furnace. Blower housings of the present invention were constructed to reduce this noise and tested in comparison with known blower housings as described below. As shown in Table I, the 56 Hz frequency was noticeably lowered when contact structure similar to ridges 170, 170', and 170", described above with reference to FIGS. 9-11, were used on the blower housing.

The blowers on the furnace were run in an unfired condition in a fully anechoic sound room. A microphone was placed three feet from the front of the furnace to record the sound signatures of each test. Table I indicates the recorded pure tone at 56 Hz for each test. Table I also includes results from actual vibration tests recorded by an automated tester on the production test equipment.

The tester tested several frequency bands. The 44 to 88 band (44/88) averaged all the frequencies between and including 44 Hz and 88 Hz and recorded the vibration level in dBg (acceleration measured in decibels). 44/88H denotes a horizontal mode of vibration detection and 44/88V denotes a vertical mode of vibration detection. Lesser values in the 44/88V and 44/88H columns denote better results and less vibration than greater values.

Figure 1:
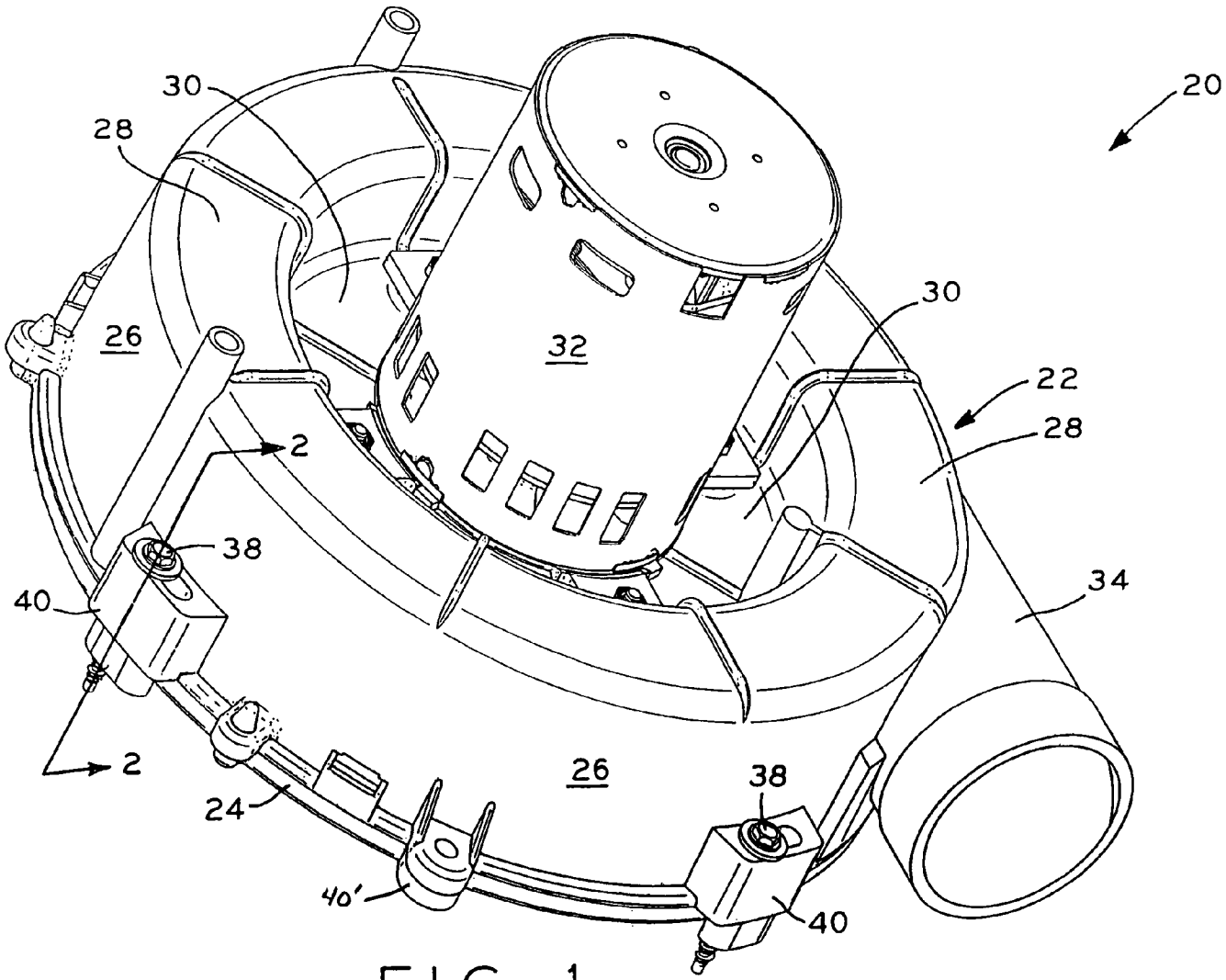
FIG. 1 PRIOR ART
FIG. 1 is a perspective view of a known draft inducer blower for high efficiency furnaces.
Figure 2:
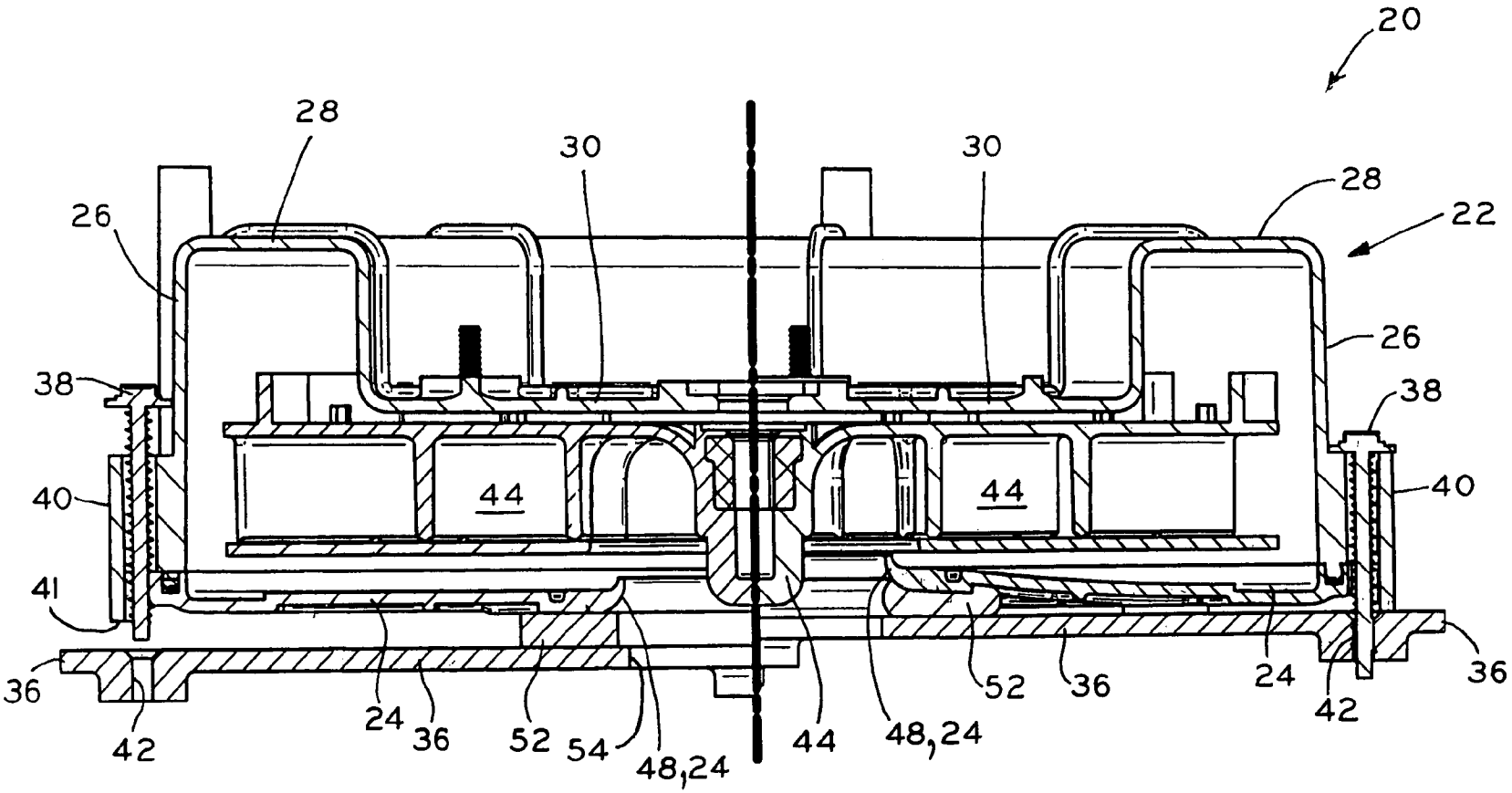
FIG. 2 PRIOR ART
FIG. 2 is a vertical sectional view through the blower housing and impeller of the blower of FIG. 1, taken along line 2-2 of FIG. 1, showing the blower housing positioned near a collector box on the left side of FIG. 2, and showing the blower housing attached to the collector box on the right side of FIG. 2.

The "Standard Blower Housing Noise" column represents the 56 Hz tone when using the standard blower housings as illustrated in FIGS. 1-3 to provide control values for the noise generated as comparative values. In columns 5-8, the dimensions of ridges 170, 170', or 170" are given in Height×Width and illustrate the noise generated by each form of protrusions utilized in the test. For example, as shown in the fifth column from the left in Table I, when a 0.125" (height) and 0.15" (width) ridge was used on a blower housing, the noise generated was less than the noise generated with a standard blower housing.

TABLE I

| Number of Blower Housing | 44/88V Freq. Band (dBg) | 44/88H Freq. Band (dBg) | Standard Blower Housing 56 Hz Pure Tone (dB) | Noise with 0.125" × 0.15" ridge 56 Hz (dB) | Noise with 0.125" × 0.95" ridge 56 Hz (dB) | Noise with (2) 0.125" × 0.15" ridges 56 Hz (dB) | Noise with 0.125" × 0.30" ridge 56 Hz (dB) |
|---|---|---|---|---|---|---|---|
| 1 | 103.388 | 98.98462 | 52.492 | 49.165 | 47.69 | 49.165 | 43.752 |
| 2 | 102.668 | 101.55 | 51.173 | 42.759 | 46.698 | 43.054 | 44.314 |
| 3 | 100.901 | 96.92582 | 51.181 | 48.588 | 42.565 | 48.42 | 44.065 |
| 4 | 95.4932 | 101.6284 | 45.993 | 34.771 | 34.232 | 32.848 | 40.864 |
| 5 | 98.782 | 101.3214 | 43.909 | 38.028 | 40.354 | 44.065 | 42.805 |

As shown in Table I, Number 4 blower housing produced the best 44/88V vibration test and Number 3 blower housing produced the best 44/88H vibration test. In general, the ridges provided on a standard blower housing, such as that shown in FIGS. 1-2, reduced the level of noise frequency in the furnace. For example, for Number 1 blower housing, including a single ridge of 0.125"×0.15" dimensions reduced the 56 Hz pure tone from 52.992 dB to 49.165 dB and including a single ridge of 0.125"×0.30" dimensions reduced the 56 Hz pure tone to 43.752 dB. Similarly, including a single ridge of 0.125"×0.95" dimensions on Number 1 blower housing reduced the 56 Hz pure tone to 47.69 dB and including two ridges each having 0.125"×0.15" dimensions on Number 1 blower housing reduced the 56 Hz pure tone to 49.165 dB. The remainder of the blower housings listed in Table I produced similar results. In all cases, the data in Table I shows a noise reduction when contact structure such as those described above was used on each blower housing.

While this invention has been described as having an exemplary design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A blower housing having an outer periphery and a central axis defining perpendicular axial and radial directions, comprising:

a housing body including a top wall, a side wall, and a plurality of mounting lugs disposed around said side wall;

a housing cover including a bottom wall, said housing cover fittable to said housing body with said mounting lugs extending in the axial direction beyond said housing cover bottom wall; and at least one contact structure integrally formed with one of said housing body and said housing cover, said contact structure extending along at least a substantial portion of the blower housing periphery and extending in the axial direction a distance greater than said mounting lugs.

2. The blower housing of claim 1, wherein said contact structure is integrally formed with said housing body, said contact structure disposed at least in part circumferentially between said mounting lugs.

3. The blower housing of claim 1, wherein said mounting lugs include openings therethrough, and said blower housing further includes a plurality of fasteners insertable through respective said openings.

4. The blower housing of claim 3, wherein said contact structure is integrally formed with said housing cover, said contact structure disposed at least in part radially inwardly of said fasteners.

5. The blower housing of claim 1, wherein said contact structure includes at least one structure selected from the group consisting of:

a plurality of individual protuberances;
a single continuous ridge;
a plurality of continuous ridges;
a plurality of concentric, continuous ridges;
a plurality of discontinuous ridges; and
a plurality of discontinuous ridges.

6. A blower housing having an outer periphery and a central axis defining perpendicular axial and radial directions, comprising:

a housing body including a top wall, a side wall, and a plurality of mounting lugs disposed around said side wall, each said mounting lug extending a distance in the axial direction and including an opening;

a housing cover including a bottom wall, said housing cover fittable to said housing body;

at least one contact structure integrally formed with one of said housing body and said housing cover, said contact structure disposed at least in part radially inwardly of said openings of said mounting lugs, said contact structure extending along at least a substantial portion of the blower housing periphery, said contact structure extending a distance in the axial direction that is larger than said mounting lug distance; and a plurality of fasteners insertable through respective openings of said mounting lugs, said fasteners extendable in the axial direction beyond said mounting lugs and said contact structure.

7. The blower housing of claim 6, wherein said contact structure is integrally formed with said housing body, said contact structure extending in the axial direction from said housing body at least as far as said mounting lugs.

8. The blower housing of claim 6, wherein said contact structure is integrally formed with said housing cover, said contact structure extending in the axial direction from said housing cover at least as far as said mounting lugs.

9. The blower housing of claim 8, wherein said contact structure is disposed at least in part radially inwardly of said fasteners.

10. The blower housing of claim 6, wherein said contact structure includes at least one structure selected from the group consisting of:

a plurality of individual protuberances;
a single continuous ridge;
a plurality of continuous ridges;
a plurality of concentric, continuous ridges;
a plurality of discontinuous ridges; and
a plurality of discontinuous concentric ridges.

11. In combination:

a furnace, including a wall having a plurality of mounting holes therein; and a blower housing having an outer periphery and a central axis defining perpendicular axial and radial directions, comprising:

a housing body having a plurality of mounting lugs, each mounting lug extending a distance in the axial direction;

a plurality of fasteners extending through respective said mounting lugs and into respective said mounting holes; and a housing cover fittable to said housing body, said housing cover including contact structure disposed at least in part radially inwardly of said fasteners and extending a distance in the axial direction from said housing cover that is larger than said mounting lug distance and into direct abutment with said furnace wall, said contact structure extending along at least a substantial portion of the blower housing periphery.

12. The combination of claim 11, wherein said furnace wall comprises a portion of a furnace collector box, said collector box further including at least a pair of side walls depending from said furnace wall, said contact structure abuttable with said furnace wall in at least two locations on said furnace wall adjacent said side walls.

13. The combination of claim 11, wherein said contact structure is integrally formed with said housing cover, said contact structure extending in the axial direction from said housing cover at least as far as said mounting lugs.

14. The combination of claim 11, wherein said contact structure includes at least one structure selected from the group consisting of:

a plurality of individual protuberances;
a single continuous ridge;
a plurality of continuous ridges;
a plurality of concentric, continuous ridges;
a plurality of discontinuous ridges; and
a plurality of discontinuous concentric ridges.

* * * * *